US011378895B2

(12) United States Patent
Sano et al.

(10) Patent No.: US 11,378,895 B2
(45) Date of Patent: Jul. 5, 2022

(54) IMAGE FORMING APPARATUS WITH DEVELOPING ROLLER SEPARATION PROCESSING

(71) Applicant: BROTHER KOGYO KABUSHIKI KAISHA, Nagoya (JP)

(72) Inventors: Toshiyuki Sano, Iwakura (JP); Yusuke Ikegami, Nagoya (JP); Junya Sumida, Ama (JP); Chieko Mimura, Nagoya (JP); Shintaro Sakaguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/171,024

(22) Filed: Feb. 9, 2021

(65) Prior Publication Data

US 2021/0294253 A1 Sep. 23, 2021

(30) Foreign Application Priority Data

Mar. 23, 2020 (JP) ..... JP2020-051543

(51) Int. Cl.
*G03G 15/01* (2006.01)
*G03G 15/23* (2006.01)
*G03G 15/00* (2006.01)

(52) U.S. Cl.
CPC ..... *G03G 15/01* (2013.01); *G03G 15/238* (2013.01); *G03G 15/5029* (2013.01)

(58) Field of Classification Search
CPC ..... G03G 21/0813; G03G 21/1825
See application file for complete search history.

(56) References Cited

U.S. PATENT DOCUMENTS 7,292,819 B2 * 11/2007 Ueda ..... B65H 3/06 271/258.01
7,809,299 B2 * 10/2010 Yamamoto ..... G03G 15/0194 399/82
2015/0277261 A1 * 10/2015 Suzuki ..... G03G 15/234 399/228
2016/0041509 A1 2/2016 Sekiguchi et al.

FOREIGN PATENT DOCUMENTS

JP 2000010359 A * 1/2000
JP 2009-258432 A 11/2009
JP 2015206942 A * 11/2015
JP 2016-038562 A 3/2016

* cited by examiner

*Primary Examiner* — Leon W Rhodes, Jr.
(74) *Attorney, Agent, or Firm* — Scully, Scott, Murphy & Presser, PC

(57) ABSTRACT

A controller is configured to: when an inter-sheet time is shorter than or equal to a first time, maintain a developing roller in contact with a photosensitive drum during an inter-sheet time; when the inter-sheet time is longer than the first time and shorter than or equal to a second time longer than the first time, perform, during the inter-sheet time, at least part of temporary separation processing of temporarily separating the developing roller from the photosensitive drum in a state where the photosensitive drum is rotating; and when the inter-sheet time is longer than the second time, perform, during the inter-sheet time, at least part of temporary stop processing of separating the developing roller from the photosensitive drum and then stopping rotation of the photosensitive drum, and subsequently restarting rotation thereof and then bringing the developing roller into contact with the photosensitive drum.

7 Claims, 10 Drawing Sheets

| DUPLEX MODE | page | EXECUTION MODE |
|---|---|---|
| 21DX | 2 | |
| | | TEMPORARY STOP PROCESSING |
| | 1 | |
| 2413DX | 2 | |
| | | TEMPORARY SEPARATION PROCESSING |
| | 4 | |
| | | TEMPORARY SEPARATION PROCESSING |
| | 1 | |
| | | TEMPORARY SEPARATION PROCESSING |
| | 3 | |
| 2461DX (N Page) | 2 | |
| | | TEMPORARY SEPARATION PROCESSING |
| | 4 | |
| | | TEMPORARY SEPARATION PROCESSING |
| | 6 | |
| | | MAINTAINING PROCESSING |
| | 1 | |
| | | MAINTAINING PROCESSING |
| | 8 | |
| | | MAINTAINING PROCESSING |
| | ⋮ | |
| | | MAINTAINING PROCESSING |
| | EVEN NUMBER | |
| | | MAINTAINING PROCESSING |
| | ODD NUMBER | |
| | | MAINTAINING PROCESSING |
| | ODD NUMBER | |
| | | TEMPORARY SEPARATION PROCESSING |
| | N | |

FIG. 6A

| DUPLEX MODE | page | EXECUTION MODE |
|---|---|---|
| 21DX | 2 | TEMPORARY STOP PROCESSING |
| | 1 | |
| 2413DX | 2 | TEMPORARY SEPARATION PROCESSING |
| | 4 | TEMPORARY SEPARATION PROCESSING |
| | 1 | TEMPORARY SEPARATION PROCESSING |
| | 3 | TEMPORARY SEPARATION PROCESSING |
| 2461DX (N Page) | 2 | TEMPORARY SEPARATION PROCESSING |
| | 4 | TEMPORARY SEPARATION PROCESSING |
| | 6 | TEMPORARY SEPARATION PROCESSING |
| | 1 | MAINTAINING PROCESSING |
| | 8 | MAINTAINING PROCESSING |
| | ⋮ | MAINTAINING PROCESSING |
| | EVEN NUMBER | MAINTAINING PROCESSING |
| | ODD NUMBER | MAINTAINING PROCESSING |
| | ODD NUMBER | MAINTAINING PROCESSING |
| | N | TEMPORARY SEPARATION PROCESSING |

FIG. 6B

| DUPLEX MODE | page | EXECUTION MODE |
|---|---|---|
| 2413DX LONG (RECORDING PAPER) | 2 | TEMPORARY SEPARATION PROCESSING |
| | 4 | TEMPORARY SEPARATION PROCESSING |
| | 1 | TEMPORARY SEPARATION PROCESSING |
| | 3 | TEMPORARY SEPARATION PROCESSING |
| 2416DX LONG (RECORDING PAPER (N Page)) | 2 | TEMPORARY SEPARATION PROCESSING |
| | 4 | TEMPORARY SEPARATION PROCESSING |
| | 1 | MAINTAINING PROCESSING |
| | 6 | MAINTAINING PROCESSING |
| | ⋮ | MAINTAINING PROCESSING |
| | EVEN NUMBER | MAINTAINING PROCESSING |
| | ODD NUMBER | MAINTAINING PROCESSING |
| | N | TEMPORARY SEPARATION PROCESSING |

FIG. 6C

| DUPLEX MODE | page | EXECUTION MODE |
|---|---|---|
| 21DX | 2 | |
| | | TEMPORARY STOP PROCESSING |
| | 1 | |
| 2413DX | 2 | |
| | | TEMPORARY SEPARATION PROCESSING |
| | 4 | |
| | | TEMPORARY SEPARATION PROCESSING |
| | 1 | |
| | | TEMPORARY SEPARATION PROCESSING |
| | 3 | |
| 2416DX (N Page) | 2 | |
| | | TEMPORARY SEPARATION PROCESSING |
| | 4 | |
| | | TEMPORARY SEPARATION PROCESSING |
| | 1 | |
| | | MAINTAINING PROCESSING |
| | 6 | |
| | | TEMPORARY SEPARATION PROCESSING |
| | 3 | |
| | | MAINTAINING PROCESSING |
| | 8 | |
| | | TEMPORARY SEPARATION PROCESSING |
| | ⋮ | |
| | | MAINTAINING PROCESSING |
| | EVEN NUMBER | |
| | | TEMPORARY SEPARATION PROCESSING |
| | ODD NUMBER | |
| | | MAINTAINING PROCESSING |
| | EVEN NUMBER | |
| | | TEMPORARY SEPARATION PROCESSING |
| | ODD NUMBER | |
| | | TEMPORARY SEPARATION PROCESSING |
| | N | |

IMAGE FORMING APPARATUS WITH DEVELOPING ROLLER SEPARATION PROCESSING

CROSS REFERENCE TO RELATED APPLICATIONS

This application claims priority from Japanese Patent Application No. 2020-051543 filed Mar. 23, 2020. The entire content of the priority application is incorporated herein by reference.

TECHNICAL FIELD

This disclosure relates to an image forming apparatus.

BACKGROUND

An image forming apparatus having a separation mechanism is conventionally known. The separation mechanism is configured to cause a developing roller to contact or separate from a photosensitive drum.

SUMMARY

According to one aspect, this specification discloses an image forming apparatus. The image forming apparatus includes a photosensitive drum, a developing roller, a transfer member, a moving mechanism, a drive mechanism, and a controller. The developing roller is configured to move between a contact position at which the developing roller contacts the photosensitive drum and a separation position at which the developing roller is separated from the photosensitive drum. The transfer member is configured to form a transfer nip with the photosensitive drum. The moving mechanism is configured to move the developing roller between the contact position and the separation position. The drive mechanism is configured to drive the photosensitive drum. The controller is configured to: in a case where an inter-sheet time is shorter than or equal to a first time, maintain the developing roller in contact with the photosensitive drum during the inter-sheet time, the inter-sheet time being a time after a trailing end of a sheet corresponding to a particular page reaches the transfer nip and before a leading end of a sheet corresponding to a next page reaches the transfer nip in a case where a plurality of pages is printed successively; in a case where the inter-sheet time is longer than the first time and shorter than or equal to a second time longer than the first time, perform at least part of temporary separation processing during the inter-sheet time, the temporary separation processing being processing of controlling, in a state where the photosensitive drum is rotating, the moving mechanism and the drive mechanism to separate the developing roller from the photosensitive drum and subsequently bring the developing roller into contact with the photosensitive drum; and in a case where the inter-sheet time is longer than the second time, perform at least part of temporary stop processing during the inter-sheet time, the temporary stop processing being processing of controlling the moving mechanism and the drive mechanism to separate the developing roller from the photosensitive drum and then stop rotation of the photosensitive drum, and subsequently restart rotation of the photosensitive drum and then bring the developing roller into contact with the photosensitive drum.

According to another aspect, this specification also discloses an image forming apparatus. The image forming apparatus includes a photosensitive drum, a developing roller, a transfer member, a moving mechanism, a drive mechanism, and a controller. The developing roller is configured to move between a contact position at which the developing roller contacts the photosensitive drum and a separation position at which the developing roller is separated from the photosensitive drum. The transfer member is configured to form a transfer nip with the photosensitive drum. The moving mechanism is configured to move the developing roller between the contact position and the separation position. The drive mechanism is configured to drive the photosensitive drum. The controller is configured to: when performing duplex printing such that only one sheet formed with a toner image on at least one surface thereof is retained within the image forming apparatus, perform at least part of temporary stop processing during a time after a trailing end of a sheet corresponding to a particular page reaches the transfer nip and before a leading end of a sheet corresponding to a next page reaches the transfer nip, the temporary stop processing being processing of controlling the moving mechanism and the drive mechanism to separate the developing roller from the photosensitive drum and then stop rotation of the photosensitive drum and subsequently restart rotation of the photosensitive drum and then bring the developing roller into contact with the photosensitive drum; and when performing duplex printing such that two or more sheets formed with a toner image on at least one surface thereof are retained within the image forming apparatus, maintain the developing roller in contact with the photosensitive drum or perform at least part of temporary separation processing during a time after a trailing end of a sheet corresponding to a particular page reaches the transfer nip and before a leading end of a sheet corresponding to a next page reaches the transfer nip, the temporary separation processing being processing of controlling, in a state where the photosensitive drum is rotating, the moving mechanism and the drive mechanism to separate the developing roller from the photosensitive drum and subsequently bring the developing roller into contact with the photosensitive drum.

According to still another aspect, this specification also discloses an image forming apparatus. The image forming apparatus includes a photosensitive drum, a developing roller, a transfer member, a moving mechanism, a drive mechanism, a sheet sensor, and a controller. The developing roller is configured to move between a contact position at which the developing roller contacts the photosensitive drum and a separation position at which the developing roller is separated from the photosensitive drum. The transfer member is configured to form a transfer nip with the photosensitive drum. The moving mechanism is configured to move the developing roller between the contact position and the separation position. The drive mechanism is configured to drive the photosensitive drum. The sheet sensor is configured to detect a sheet at a position upstream of the transfer nip in a conveyance direction of the sheet. The controller is configured to, in a case where an inter-sheet time is shorter than a first time, maintain the developing roller in contact with the photosensitive drum during the inter-sheet time. The inter-sheet time is a time after a trailing end of a sheet corresponding to a particular page reaches the transfer nip and before a leading end of a sheet corresponding to a next page reaches the transfer nip in a case where a plurality of pages is printed successively.

BRIEF DESCRIPTION OF THE DRAWINGS

Embodiments in accordance with this disclosure will be described in detail with reference to the following figures wherein:

FIGS. 6A to 6C are tables showing each processing to be executed between each page of duplex printing;

DETAILED DESCRIPTION

In an image forming apparatus that performs development by causing a developing roller to contact a photosensitive drum, there is a problem that the developing roller and the photosensitive drum deteriorate if the developing roller is left in contact with the photosensitive drum during print processing.

In view of the foregoing, an aspect of an objective of this disclosure is to suppress deterioration of the developing roller and the photosensitive drum.

Hereinafter, an embodiment of this disclosure will be described in detail with reference to the drawings as appropriate.

Figure 1:
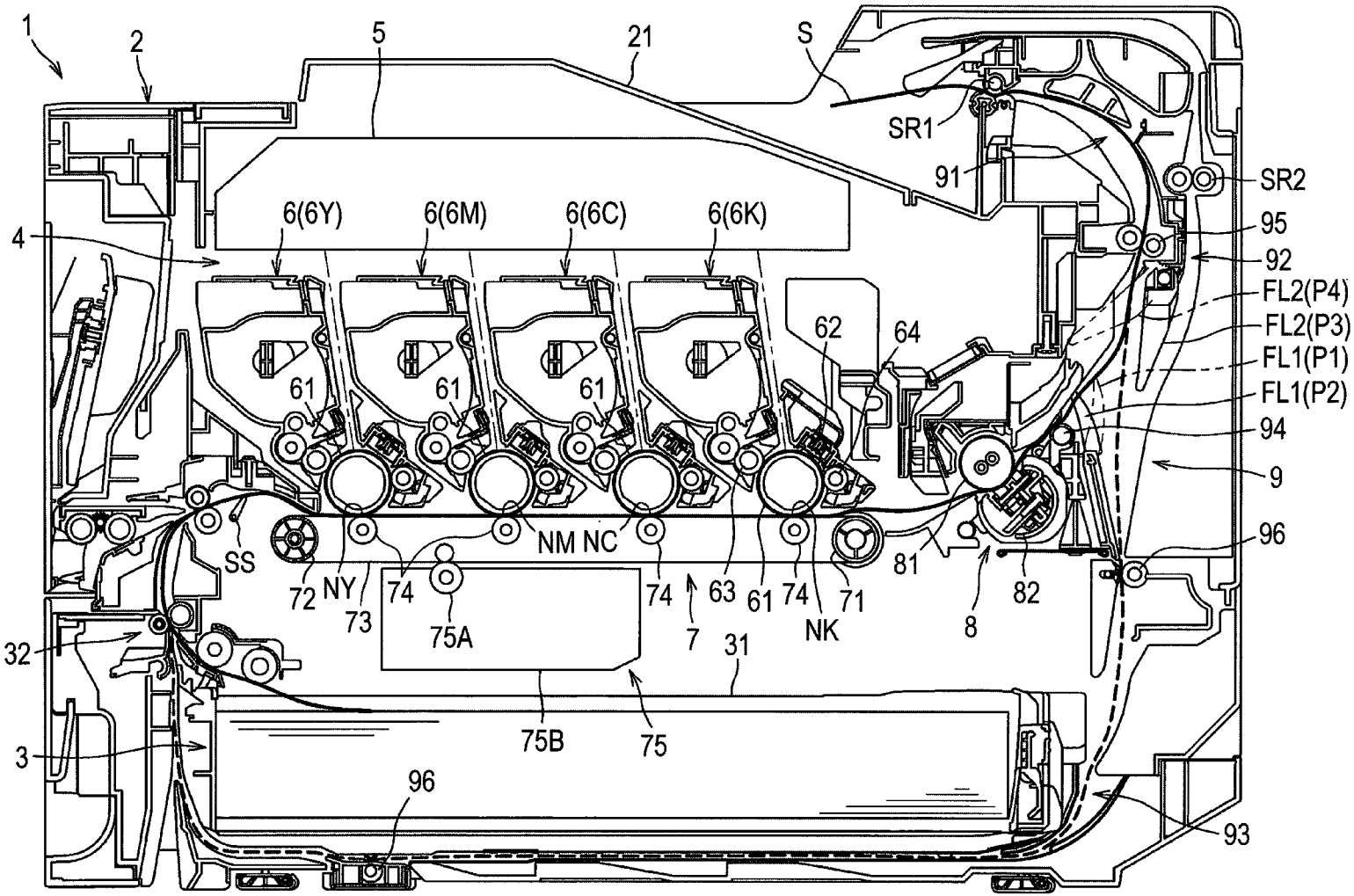
FIG. 1 is a schematic diagram showing a color printer according to an embodiment of this disclosure.

As shown in FIG. 1, a color printer 1 as an example of an image forming apparatus is configured to perform color printing and monochrome printing and to form an image on both sides of a sheet S. The color printer 1 includes a main housing 2, a supply unit 3, an image forming unit 4, a fixing device 8, and a conveyance unit 9 arranged inside the main housing 2. The main housing 2 has a discharge tray 21 on the upper surface thereof.

The supply unit 3 is provided in the lower part of the main housing 2, and includes a supply tray 31 for accommodating the sheet S and a supply mechanism 32 for supplying the sheet S in the supply tray 31 to the image forming unit 4.

The image forming unit 4 has a function of transferring a toner image to the sheet S to form an image, and includes an exposure device 5, four process units 6, and a transfer unit 7 as an example of a transfer member.

The exposure device 5 is arranged in the upper part of the main housing 2 and includes a light source (not shown), a polygon mirror, and so on. The exposure device 5 exposes the surface of a photosensitive drum 61 by irradiating the surface of the photosensitive drum 61 with light.

The process unit 6 includes the photosensitive drum 61, a charger 62, and a developing roller 63. The process unit 6 further includes a drum cleaner 64 configured to contact the photosensitive drum 61 and clean toner and the like on the photosensitive drum 61. Toner of respective colors of yellow, magenta, cyan and black is contained in the four process units 6.

Regarding the process units 6, the process units 6Y, 6M, 6C, and 6K containing toner of respective colors of yellow, magenta, cyan, and black are arranged in this order from the upstream in the conveyance direction of the sheet S. In the present specification and drawings, when the photosensitive drums 61, the developing rollers 63, and so on corresponding to the colors of toner are specified, the symbols Y, M, C, and K for yellow, magenta, cyan, and black, respectively, will be added.

Figure 2A:
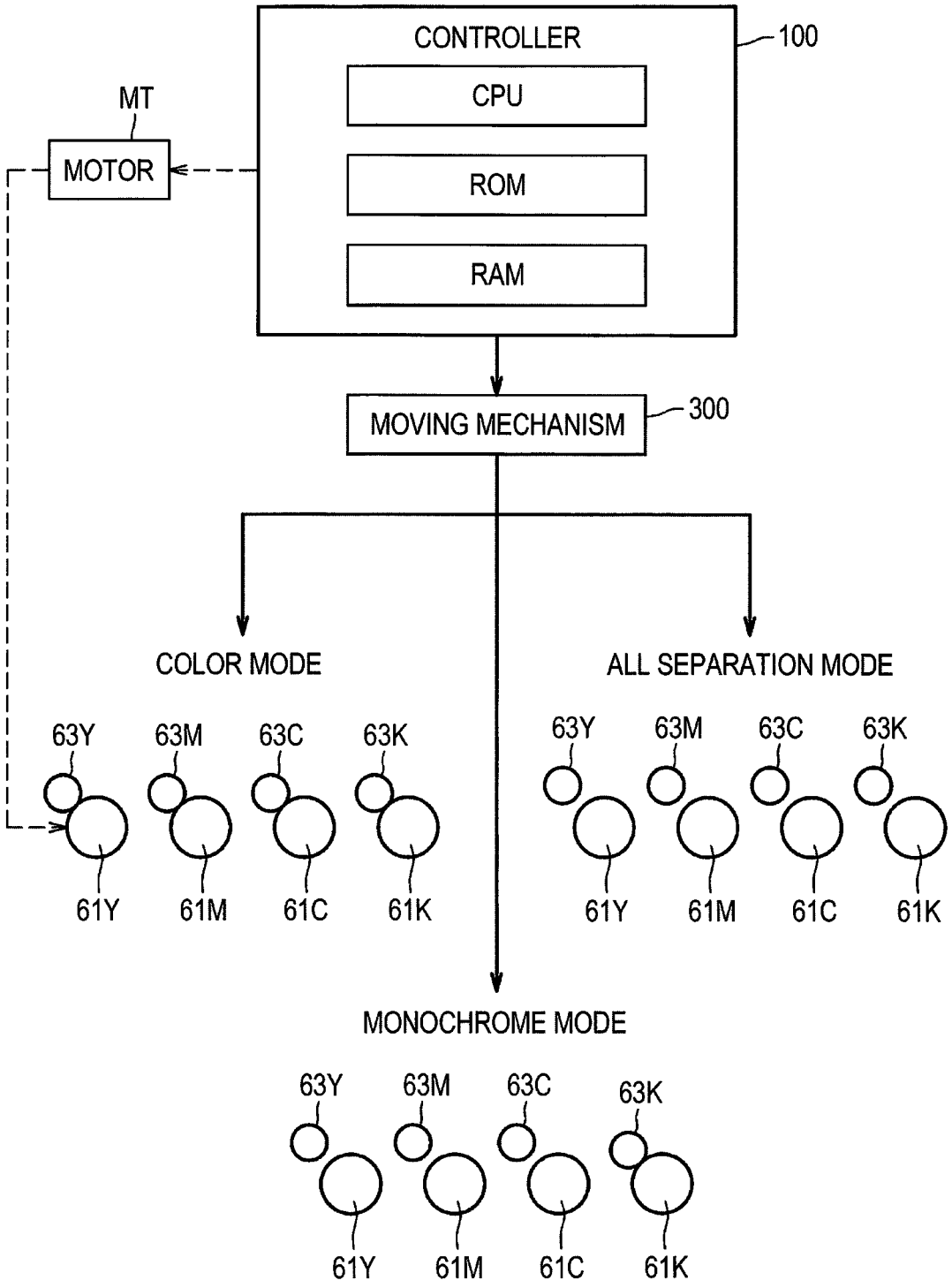
FIG. 2A is an explanatory diagram showing the states of separation/contact between photosensitive drums and developing rollers.

As shown in FIG. 2A, the developing roller 63 is configured to move between a contact position at which the developing roller 63 contacts the photosensitive drum 61 and a separation position at which the developing roller 63 is separated from the photosensitive drum 61. The color printer 1 further includes a moving mechanism (separation mechanism) 300, a motor MT as an example of a drive mechanism, and a controller 100. The moving mechanism 300 is a mechanism that moves the developing roller 63 between the contact position and the separation position. The motor MT is a motor for driving the photosensitive drum 61. The controller 100 has a CPU, a ROM, a RAM, and so on, and is configured to execute various processing in response to the reception of a print command and so on according to a program prepared in advance. The controller 100 controls the moving mechanism 300 and the motor MT.

Figure 2B:
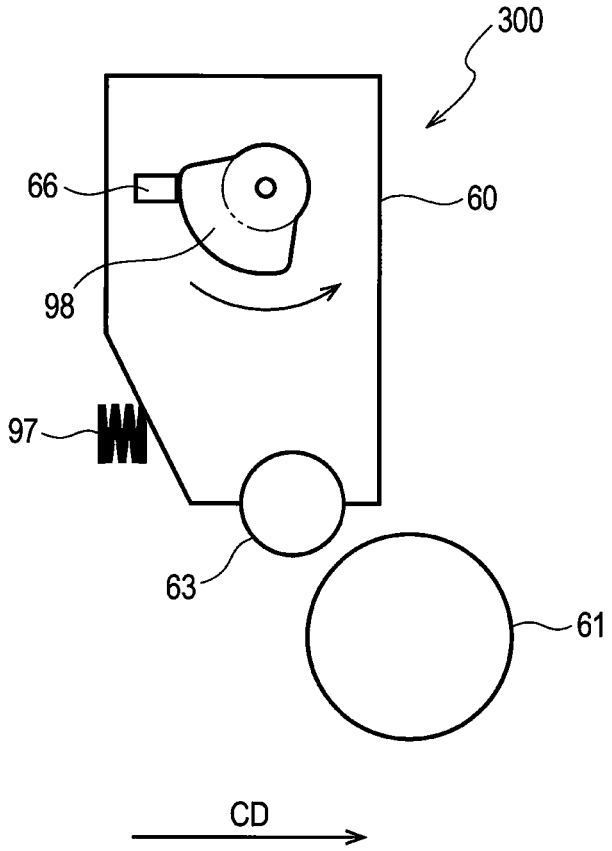
FIG. 2B is a schematic diagram showing an example of a configuration of a moving mechanism.

FIG. 2B shows an example of the configuration of the moving mechanism 300. The developing roller 63 is rotatably supported by a developing roller support member 60. A cam 98 and a spring 97 are provided at the main housing 2 side. The rotational position of the cam 98 is controlled by the controller 100. The spring 97 urges the developing roller support member 60 in a direction from the upstream side toward the downstream side in the conveyance direction CD of the sheet S. A pressed portion 66 is provided at the developing roller support member 60. The pressed portion 66 protrudes outward in the axial direction of the developing roller 63 from the developing roller support member 60. When the pressed portion 66 (that is, the developing roller support member 60) is pressed by the cam 98 from the downstream side toward the upstream side in the conveyance direction CD, the developing roller support member 60 moves to a separation position where the developing roller 63 is separated from the photosensitive drum 61, against the urging force of the spring 97. When the pressure by the cam 98 is released, the developing roller support member 60 moves to a contact position where the developing roller 63 contacts the photosensitive drum 61 due to the urging force of the spring 97.

Specifically, the controller 100 executes a color mode, a monochrome mode, and an all separation mode. In the color mode in which color printing is performed, the controller 100 performs control such that all the developing rollers 63Y, 63M, 63C, 63K contact the corresponding photosensitive drums 61Y, 61M, 61C, 61K. In the monochrome mode in which the controller 100 performs monochrome printing, the controller 100 performs control such that only the developing roller 63K for black contacts the photosensitive drum 61K, and the other three colors developing rollers 63Y, 63M, 63C separate from the corresponding photosensitive drums 61Y, 61M, 61C. That is, the photosensitive drum 61K and the developing roller 63K are examples of a first photosensitive drum and a first developing roller, respectively, which are used for both monochrome printing and color printing. The photosensitive drums 61Y, 61M, 61C and the developing rollers 63Y, 63M, 63C are examples of second photosensitive drums and second developing rollers, respectively, which are used only for color printing. Further, when cleaning the photosensitive drums 61, for example, the controller 100 executes the all separation mode to separate all the developing rollers 63Y, 63M, 63C, 63K from the corresponding photosensitive drums 61Y, 61M, 61C, 61K, respectively.

As shown in FIG. 1, the transfer unit 7 includes a drive roller 71, a follow roller 72, a conveyance belt 73, and four transfer rollers 74. The conveyance belt 73 is an endless belt, and is stretched between the drive roller 71 and the follow roller 72. Inside the conveyance belt 73, the transfer rollers 74 are arranged so as to sandwich the conveyance belt 73 with the corresponding photosensitive drums 61.

The transfer unit 7 forms, together with each photosensitive drum 61 therebetween, transfer nips NY, NM, NC, and NK for transferring a toner image on each photosensitive drum 61 to the sheet S. Specifically, the transfer nips NY, NM, NC, and NK are formed between each photosensitive drum 61 and the conveyance belt 73.

A cleaning member 75 configured to clean toner on the conveyance belt 73 of the transfer unit 7 is arranged below the transfer unit 7. The cleaning member 75 includes a cleaning roller 75A that contacts the conveyance belt 73 to collect the toner on the conveyance belt 73, and a waste toner accommodating portion 75B that stores the toner collected by the cleaning roller 75A.

The charger 62 charges the surface of the photosensitive drum 61. After that, the exposure device 5 exposes the surface of the photosensitive drum 61 to form an electrostatic latent image based on image data on the surface of the photosensitive drum 61.

The developing roller 63 supplies toner to the electrostatic latent image formed on the photosensitive drum 61. As a result, a toner image is formed on the photosensitive drum 61. After that, when the sheet S is conveyed between the photosensitive drum 61 and the transfer roller 74 by the conveyance belt 73, the toner image on the photosensitive drum 61 is transferred onto the sheet S.

A sheet sensor SS for detecting the presence or absence of the sheet S is provided upstream of the image forming unit 4 in the conveyance direction of the sheet S. The sheet sensor SS includes a swing lever that is pushed by the conveyed sheet S and swings, for example, and an optical sensor that detects the swing of the swing lever. In this embodiment, it is assumed that the sheet sensor SS is ON while the sheet S is passing, that is, when the swing lever is tilted by the sheet S, and that the sheet sensor SS is OFF while the sheet S is not passing, that is, when the swing lever is not tilted by the sheet S. The relationship between the posture of the swing lever and ON and OFF of the sheet sensor SS may be reversed.

The fixing device 8 is a device that thermally fixes the toner image on the sheet S. The fixing device 8 includes a heating roller 81 and a pressure roller 82 that sandwiches the sheet S with the heating rollers 81.

The conveyance unit 9 is configured to convey the sheet S discharged from the fixing device 8 to the outside of the main housing 2 or to the image forming unit 4 again. The conveyance unit 9 includes a first conveyance path 91, a second conveyance path 92, a reconveyance path 93, a first conveyance roller 94, a second conveyance roller 95, a first switchback roller SR1, and a second switchback roller SR2, a plurality of reconveyance rollers 96, a first flapper FL1, and a second flapper FL2.

The first conveyance path 91 is a path that guides the sheet discharged from the fixing device 8 toward the discharge tray 21. The second conveyance path 92 is a path that guides the sheet discharged from the fixing device 8 toward the discharge tray 21 by a route different from the first conveyance path 91. The reconveyance path 93 is a path that guides the sheet S drawn into the main housing 2 by the first switchback roller SR1 and so on described later, to the supply mechanism 32 on the upstream side of the image forming unit 4. The reconveyance rollers 96 convey the sheet S in the reconveyance path 93 toward the supply mechanism 32, and is provided on the reconveyance path 93.

The first conveyance roller 94 is provided in the fixing device 8. The first conveyance roller 94 conveys the sheet S on which the toner image is thermally-fixed toward the second flapper FL2.

The second conveyance roller 95, the first switchback roller SR1 and the second switchback roller SR2 are configured to rotate in the forward and reverse directions. The second conveyance roller 95, the first switchback roller SR1, and the second switchback roller SR2 convey the sheet S to the outside of the main housing 2 during forward rotation, specifically toward the discharge tray 21, and draw the sheet S into the main housing 2 during reverse rotation.

The second conveyance roller 95 and the first switchback roller SR1 are provided on the first conveyance path 91. The first switchback roller SR1 is arranged closer to the discharge tray 21 than the second conveyance roller 95 is. The second switchback roller SR2 is provided on the second conveyance path 92.

The first flapper FL1 is rotatable between a first position P1 shown by the double-dot chain line and a second position P2 shown by the solid line. When the first flapper FL1 is located at the first position P1, the first flapper FL1 guides the sheet S discharged from the fixing device 8 toward the second flapper FL2. When the first flapper FL1 is located at the second position P2, the first flapper FL1 prevents the sheet S drawn into the main housing 2 by the first switchback roller SR1 or the second switchback roller SR2 from being conveyed toward the fixing device 8.

The second flapper FL2 is rotatable between a third position P3 shown by the solid line and a fourth position P4 shown by the double-dot chain line. When the second flapper FL2 is located at the third position P3, the second flapper FL2 guides the sheet S discharged from the fixing device 8 toward the first switchback roller SR1. When the second flapper FL2 is located at the fourth position P4, the second flapper FL2 guides the sheet S discharged from the fixing device 8 toward the second switchback roller SR2.

The first flapper FL1 is urged from the first position P1 toward the second position P2 by a spring (not shown). When the sheet S discharged from the fixing device 8 pushes the first flapper FL1 against the urging force of the spring, the first flapper FL1 rotates from the second position P2 to the first position P1. Then, when the trailing end of the sheet S separates from the first flapper FL1, the first flapper FL1 rotates from the first position P1 to the second position P2 by the urging force of the spring. The second flapper FL2 is located at the third position P3 in a state where no printing is performed. The second flapper FL2 is configured to be switched between the third position P3 and the fourth position P4 by the controller 100.

The controller 100 is configured to execute duplex (double-sided) print processing of performing printing on both sides of the sheet S.

The duplex print processing executed by the controller 100 includes two modes, that is, a first duplex printing mode in which the second flapper FL2 is controlled and duplex printing is performed by using the two conveyance paths 91 and 92, and a second duplex printing mode in which duplex printing is performed by using only the first conveyance path 91 while the second flapper FL2 is not moved so as to remain at the third position P3. Alternatively, the controller 100 may be set so as to perform the first duplex printing mode in a case where the apparatus includes the second conveyance path 92 and the second flapper FL2, whereas the controller 100 may be set so as to perform the second duplex printing mode in a case where the apparatus does not include the second conveyance path 92 and the second flapper FL2.

Figure 3A:
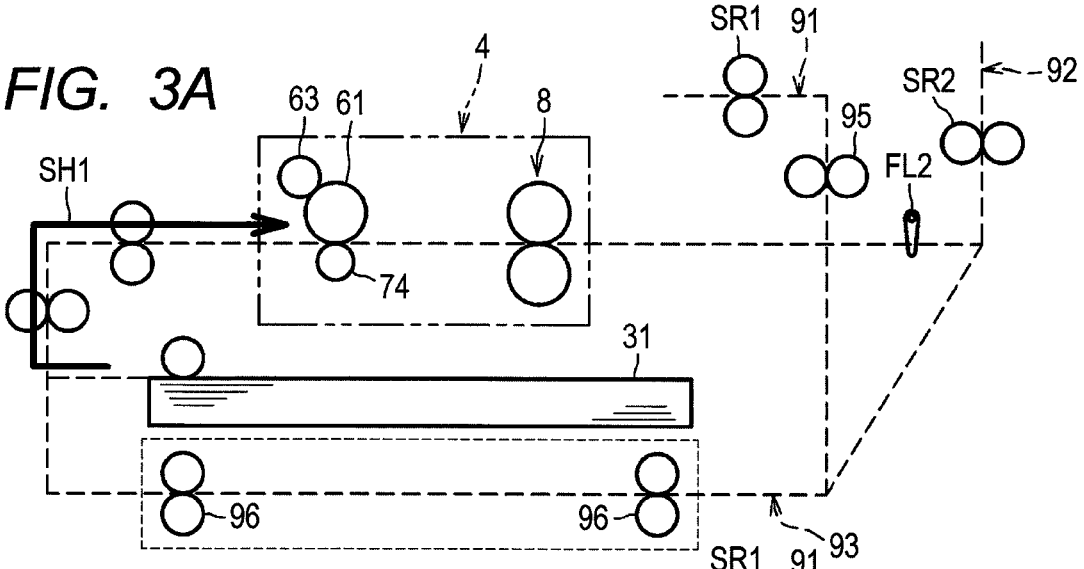
FIGS. 3A to 3C show the conveyance state of each sheet from the start of conveyance of a first sheet to the start of conveyance of a second sheet in a first duplex printing mode.
Figure 3B:
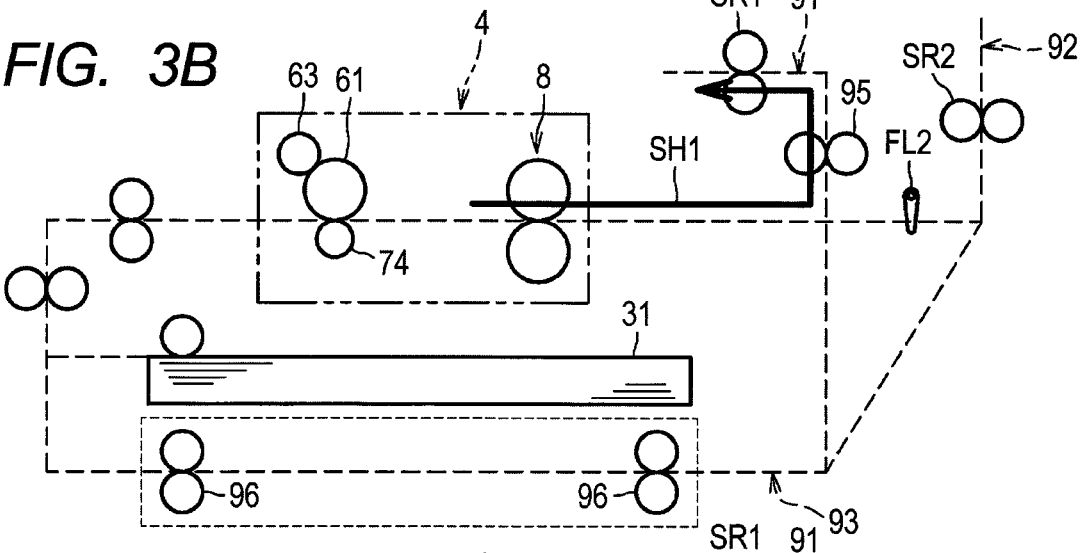
Figure 3C:
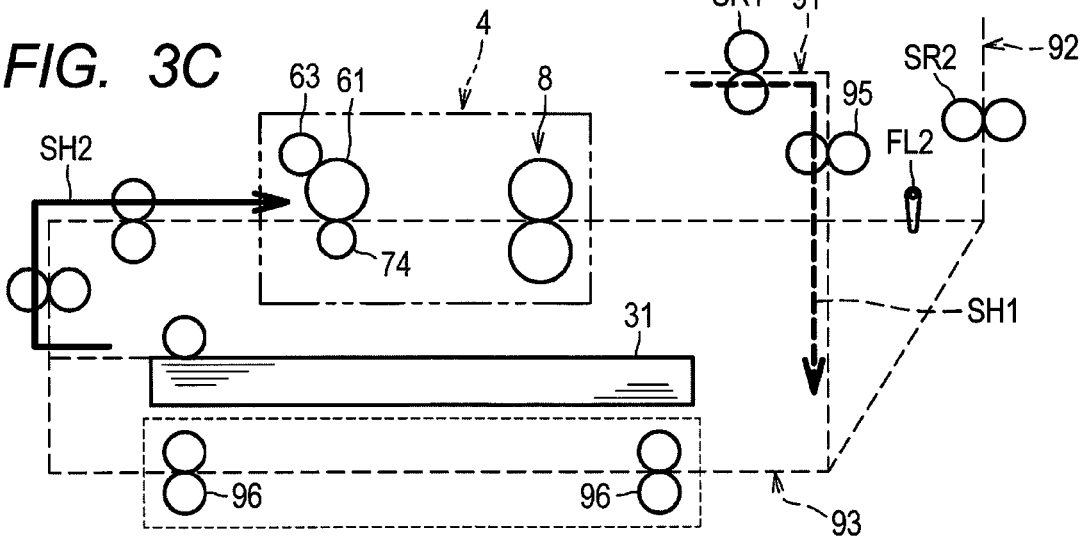

Specifically, when the duplex print processing is performed on three or more sheets S in the first duplex printing mode, as shown in FIGS. 3A and 3B, the controller 100 controls the image forming unit 4 to form an image on the first surface of the first sheet SH1 picked up from the supply tray 31, after which this sheet SH1 is conveyed to the first conveyance path 91. Thereafter, as shown in FIG. 3C, the controller 100 controls the first switchback roller SR1 and so on to reverse the conveyance direction of (switchback) the first sheet SH1 to convey the first sheet SH1 to the reconveyance path 93. In FIGS. 3A to 3C, the sheet shown by the broken line shows a sheet after the switchback. The sheet shown by the solid line shows a sheet before the switchback.

Figure 4A:
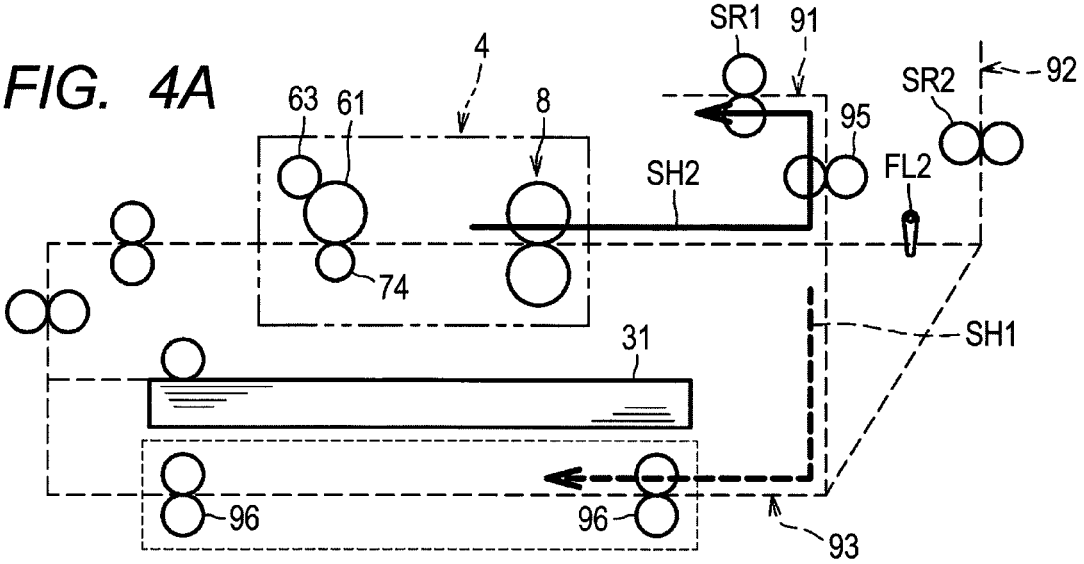
FIGS. 4A and 4B show the conveyance state of each sheet from the formation of an image on a first surface of the second sheet to the start of conveyance of a third sheet.

Next, the controller 100 picks up the second sheet SH2 from the supply tray 31 to convey the second sheet SH2 to the image forming unit 4. Thereafter, as shown in FIG. 4A, the controller 100 controls the image forming unit 4 to form an image on the first surface of the second sheet SH2 while conveying the first sheet SH1 on the reconveyance path 93 to convey this sheet SH2 to the first conveyance path 91.

Figure 4B:
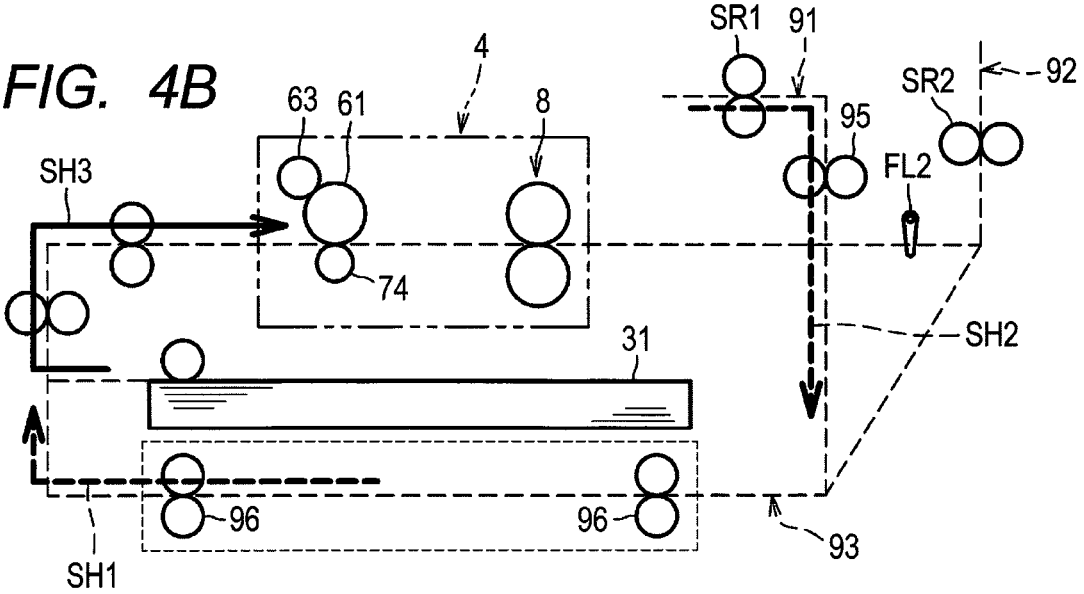

Thereafter, as shown in FIG. 4B, the controller 100 controls the first switchback roller SR1 and so on to reverse the conveyance direction of (switchback) the second sheet SH2 while conveying the first sheet SH1 on the reconveyance path 93 and convey the second sheet SH2 to the reconveyance path 93. Next, the controller 100 picks up the third sheet SH3 from the supply tray 31 to send the sheet SH3 to the downstream side of the first sheet SH1 in the conveyance direction.

Figure 5A:
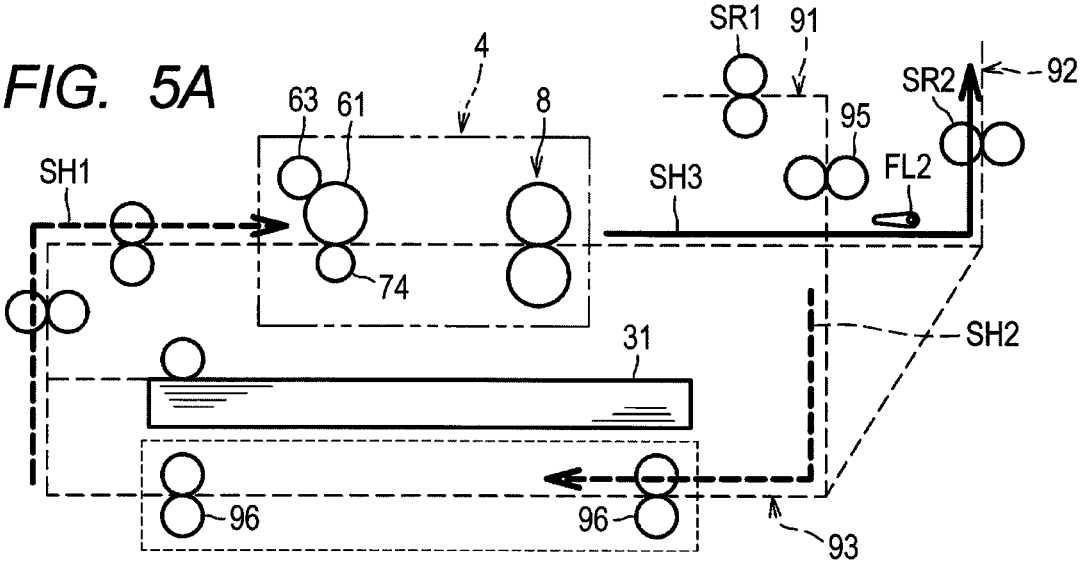
FIGS. 5A and 5B show the conveyance state of each sheet from the formation of an image on a first surface of the third sheet to the start of conveyance of a fourth sheet.

Thereafter, as shown in FIG. 5A, the controller 100 switches the second flapper FL2 from the third position P3 to the fourth position P4. As a result, the third sheet SH3 for which an image is formed on the first surface by the image forming unit 4 is conveyed to the second conveyance path 92.

Figure 5B:
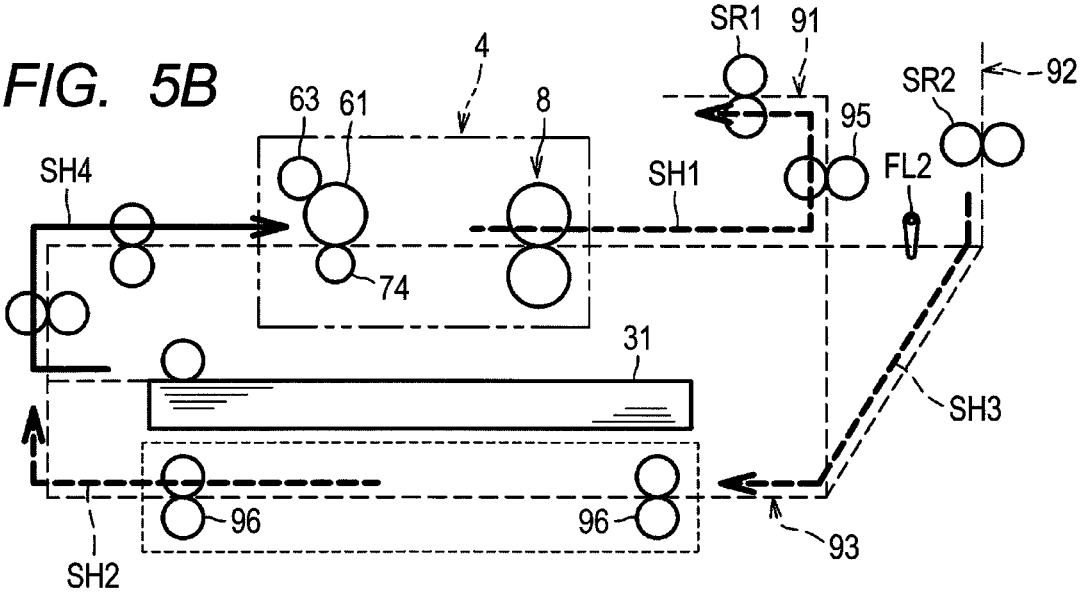

After the third sheet SH3 is conveyed to the second conveyance path 92, as shown in FIG. 5B, the controller 100 switches the second flapper FL2 from the fourth position P4 to the third position P3. Thereafter, the controller 100 controls the second switchback roller SR2 to reverse the conveyance direction of (switchback) the third sheet SH3 and controls the image forming unit 4 to form an image on the second surface of the first sheet SH1. The first sheet SH1 for which images are formed on both surfaces is discharged to the discharge tray 21 through the first conveyance path 91.

During this, the controller 100 picks up the fourth sheet SH4 from the supply tray 31 to supply this sheet SH4 to a position between the first sheet SH1 and the second sheet SH2. Thereafter, the controller 100 similarly inserts a new sheet S between the two sheets S for which images are formed on the first surfaces or switches the second flappers FL2 alternately, thereby reversing the conveyance direction of (switchback) the sheet S for which an image is formed only on the first surface through the second conveyance path 92 and discharging the sheet S for which images are formed on both surfaces to the discharge tray 21 through the first conveyance path 91.

As shown in FIGS. 3A to 3C and FIG. 4A, when the duplex print processing is performed on three or more sheets S in the second duplex printing mode, the controller 100 performs a processing similar to the first duplex printing mode to form images on each first surface of the first sheet SH1 and the second sheet SH2 and reverse the conveyance direction of (switchback) the sheets in the first conveyance path 91. Thereafter, the controller 100 forms an image on the second surface of the first sheet SH1. Next, the controller 100 picks up the third sheet SH3 from the supply tray 31 to supply this third sheet SH3 to a position between the first sheet SH1 and the second sheet SH2, and forms an image on the first surface of the third sheet SH3.

The controller 100 discharges the first sheet SH1 for which images are formed on both surfaces to the discharge tray 21 through the first conveyance path 91, and subsequently reverses the conveyance direction of (switchback) the third sheet SH3 in the first conveyance path 91. Thereafter, the controller 100 similarly inserts a new sheet S between two sheets S for which images are formed on the first surfaces to thereby discharge the sheets S for which images are formed on both surfaces to the discharge tray 21 through the first conveyance path 91, and reverses the conveyance direction of (switchback) the sheet S for which an image is formed only on the first surface in the first conveyance path 91.

The controller 100 is configured to execute temporary separation processing and temporary stop processing. The temporary separation processing is processing to control the moving mechanism 300 and the motor MT to separate the developing roller 63 from the photosensitive drum 61 and thereafter bring the developing roller 63 into contact with the photosensitive drum 61 while the photosensitive drum 61 is rotating. Specifically, in the temporary separation processing, the controller 100 controls the moving mechanism 300 while continuing the driving of the motor MT, thereby causing the developing roller 63 separate from the photosensitive drum 61 and subsequently contact the photosensitive drum 61.

The temporary stop processing is processing to control the moving mechanism 300 and the motor MT to separate the developing roller 63 from the photosensitive drum 61 and then stop the rotation of the photosensitive drum 61, and subsequently restart the rotation of the photosensitive drum 61 and then bring the developing roller 63 into contact with the photosensitive drum 61. Specifically, in the temporary stop processing, the controller 100 controls the moving mechanism 300 to separate the developing roller 63 from the photosensitive drum 61 and subsequently stops the motor MT. Thereafter, the controller 100 restarts the driving of the motor MT and then brings the developing roller 63 into contact with the photosensitive drum 61. In the temporary stop processing, the controller 100 is configured to, in accordance with the stop and restart of the rotation of the photosensitive drum 61, stop and restart the rotation of the drum cleaner 64, the drive roller 71, the transfer roller 74, and the cleaning roller 75A.

The controller 100 is configured to perform, for each color, contact and separation processing of the developing roller 63 in the temporary separation processing or the temporary stop processing described above. The contact and separation processing of the developing roller 63 performed for each color is similar processing. Thus, the following section will describe contact and separation processing of the developing roller for yellow as a typical example and will not repeat the description for other colors if the same description applies.

In order to print a plurality of pages successively, the controller 100 executes the temporary separation processing or the temporary stop processing described above depending on an inter-sheet time TS which is the time after the trailing end of the sheet S corresponding to a particular page reaches the transfer nip NY and before the leading end of the sheet S corresponding to the next page reaches the transfer nip NY. Specifically, the controller 100 is configured to, when the inter-sheet time TS is shorter than or equal to a first time T1, execute maintaining processing to maintain a state where the photosensitive drum 61Y is rotating and the developing roller 63Y is in contact with the photosensitive drum 61Y during the inter-sheet time TS.

The controller 100 is configured to, when the inter-sheet time TS is longer than the first time T1 and is shorter than or equal to a second time T2 which is longer than the first time T1, execute at least a part of the temporary separation processing during the inter-sheet time TS. That is, the entirety of the temporary separation processing may be executed during the inter-sheet time TS. Alternatively, a part of the temporary separation processing may be executed in a period before or after the inter-sheet time TS and the remaining part of the processing may be executed during the inter-sheet time TS.

Specifically, the controller 100 executes the temporary separation processing after the development of an image to be transferred to a particular page is finished and before the development of an image to be transferred to the next page is started. That is, the controller 100 is configured to separate the developing roller 63Y from the photosensitive drum 61Y after the development by the developing roller 63Y of an electrostatic latent image corresponding to the particular page on the photosensitive drum 61Y is finished, and to bring the developing roller 63Y into contact with the photosensitive drum 61Y before the development by the developing roller 63Y of an electrostatic latent image corresponding to the next page on the photosensitive drum 61Y is started.

The controller 100 executes at least a part of the temporary stop processing during the inter-sheet time TS when the inter-sheet time TS is longer than the second time T2. That is, the entirety of the temporary stop processing may be executed during the inter-sheet time TS. Alternatively, a part of the temporary stop processing may be executed in a period before or after the inter-sheet time TS, and the remaining part of the processing may be executed during the inter-sheet time TS.

Specifically, the controller 100 executes the temporary stop processing after the development of an image to be transferred to the particular page is finished and before the development of an image to be transferred to the next page is started. Specifically, the controller 100 separates the developing roller 63Y from the photosensitive drum 61Y and stops the rotation of the photosensitive drum 61Y and so on, after the development by the developing roller 63Y of the electrostatic latent image corresponding to the particular page on the photosensitive drum 61Y is finished. Thereafter, before the development by the developing roller 63Y of the electrostatic latent image corresponding to the next page on the photosensitive drum 61Y is started, the controller 100 restarts the rotation of the photosensitive drum 61Y and so on and brings the developing roller 63Y into contact with the photosensitive drum 61Y.

The controller 100 determines, based on information from the sheet sensor SS, the timing to start the temporary separation processing or the temporary stop processing described above. That is, the controller 100 starts the temporary separation processing or the temporary stop processing based on the information from the sheet sensor SS such that at least a part of the temporary separation processing or the temporary stop processing is executed during the inter-sheet time TS.

As shown in FIGS. 6A to 6C, the temporary stop processing, the temporary separation processing, and the maintaining processing are set depending on a page interval in the duplex print processing. A first table shown in FIG. 6A shows the settings of each processing when duplex printing is performed on a sheet S having a particular length in the first duplex printing mode. A second table shown in FIG. 6B shows the settings of each processing when duplex printing is performed on a long recording paper (which is a sheet S having a length longer than the particular length) in the first duplex printing mode. A third table shown in FIG. 6C shows the settings of each processing when duplex printing is performed on a sheet S having the particular length in the second duplex printing mode.

The mode "21DX" shown in the "duplex mode" column of the first table is a mode for executing the duplex print processing on both surfaces of one sheet S. In the 21DX mode, the controller 100 controls the image forming unit 4 to form an image on the first surface of a particular sheet S and subsequently form an image on the second surface of the particular sheet S. In the 21DX mode is a mode for executing the duplex printing in which only one sheet S for which a toner image is formed on at least one surface is retained within the apparatus. In the 21DX mode, because the inter-sheet time TS is longer than the second time T2, the processing executed in this mode is set to the temporary stop processing.

Similarly, for each page interval in the duplex printing, appropriate time, as the inter-sheet time TS, is set for each page interval depending on the number of the sheets S retained in the apparatus, and so on. Thus, in each table, the inter-sheet time TS is set depending on the page interval, and the processing suitable for the inter-sheet time TS is set. That is, the maintaining processing is set for a page interval for which the inter-sheet time TS is shorter than or equal to the first time T1. The temporary separation processing is set for a page interval for which $T1<TS\leq T2$ (TS is longer than T1 and shorter than or equal to T2) is satisfied. The temporary stop processing is set for a page interval for which $TS>T2$ (TS is longer than T2) is satisfied.

Specifically, the mode "2413DX" shown in the "duplex mode" column of the first table is a mode for executing duplex printing on both surfaces of two sheets S. In the 2413DX mode, the controller 100 controls the image forming unit 4 to print an image corresponding to the second page on the first surface of the first sheet S picked up from the supply tray 31, and to subsequently print an image corresponding to the fourth page on the first surface of the second sheet S picked up by the supply tray 31. Thereafter, the controller 100 controls the image forming unit 4 to print an image corresponding to the first page on the second surface of the inverted first sheet S and to print an image corresponding to the third page on the second surface of the inverted second sheet S. In the 2413DX mode, the inter-sheet time TS for each page interval is set to be longer than the first time T1 and shorter than or equal to the second time T2. Thus, the temporary separation processing is set as the processing executed in each page interval in this mode.

The mode "2461DX" shown in the "duplex mode" column of the first table is a mode for executing the duplex printing on both surfaces of three or more sheets S. In this mode, the duplex printing is performed on the second page, the fourth page, the sixth page, and the first page in this order, and subsequently the printing is performed in order of an even number, an odd number, and an even number. At the end of the duplex printing, a plurality of odd number pages is printed successively. The reason is that there is no need any more to insert a new sheet S between the two sheets S for which the first surfaces are already printed, for example. In this mode, different inter-sheet time TS is set depending on the page interval. In the following description, page intervals such as "the interval between the second page and the fourth page" will be simply denoted as "page interval 2-4" and other page intervals also will be simply denoted in a similar manner.

Specifically, in this mode, the inter-sheet time TS is set to T1<TS≤T2 for the page interval 2-4, the page interval 4-6, and the page interval between the second-from-last page and the last page. For the other page intervals, the inter-sheet time TS is set to a time which is shorter than or equal to the first time T1. Thus, the temporary separation processing is set as the processing executed on the page interval 2-4, the page interval 4-6, and the page interval between the second-from-last page and the last page, while the maintaining processing is set as the processing executed on the other page intervals.

Each processing is similarly set in the second table and the third table. The mode "2416DX" in the second table and the third table is a mode to execute the duplex printing on both surfaces of three or more sheets S. In this mode, the printing is performed on pages in an order different from that in the "2461DX" in the first table, since a sheet S longer than the particular length is conveyed or the second conveyance path 92 is not used.

The 2413DX mode, the 2461DX mode, or the 2416DX mode described above is a mode for executing the duplex printing in which two or more sheets S for which a toner image is formed on at least one surface is retained within the apparatus.

When the temporary separation processing is executed in a case where the monochrome printing is performed successively after the color printing is performed, the controller 100 separates all of the developing rollers 63 from the corresponding photosensitive drums 61 and subsequently brings only the monochrome developing roller 63K into contact with the photosensitive drum 61K in a state where all of the photosensitive drums 61 are rotating. When the temporary stop processing is executed in a case where the monochrome printing is performed successively after the color printing is performed, the controller 100 separates all of the developing rollers 63 from the corresponding photosensitive drums 61 and then stops the rotation of all of the photosensitive drums 61, and subsequently restarts the rotation of all of the photosensitive drums 61 and then brings only the monochrome developing roller 63K into contact with the photosensitive drum 61K.

When the temporary separation processing is executed in a case where the color printing is performed successively after the monochrome printing is performed, the controller 100 separates the monochrome developing roller 63K from the photosensitive drums 61K and subsequently brings all of the developing rollers 63 into contact with the corresponding photosensitive drums 61 in a state where all of the photosensitive drums 61 are rotating. When the temporary stop processing is executed in a case where the color printing is performed successively after the monochrome printing is performed, the controller 100 separates the monochrome developing roller 63K from the photosensitive drum 61K and then stops the rotation of all of the photosensitive drums 61, and subsequently restarts the rotation of all of the photosensitive drums 61 and then brings all of the developing rollers 63 into contact with the corresponding photosensitive drums 61.

When the temporary separation processing is executed in a case where the monochrome printing is performed successively after the monochrome printing is performed, the controller 100 separates the monochrome developing roller 63K from the photosensitive drum 61K and subsequently brings only the monochrome developing roller 63K into contact with the photosensitive drum 61K in a state where all of the photosensitive drums 61 are rotating. When the temporary stop processing is executed in a case where the monochrome printing is performed successively after the monochrome printing is performed, the controller 100 separates the monochrome developing roller 63K from the photosensitive drum 61K and then stops the rotation of all of the photosensitive drums 61, and subsequently restarts the rotation of all of the photosensitive drums 61 and then brings only the monochrome developing roller 63K into contact with the photosensitive drum 61K.

When the temporary separation processing is executed in a case where the color printing is performed successively after the color printing is performed, the controller 100 separates all of the developing rollers 63 from the corresponding photosensitive drums 61 and subsequently brings all of the developing rollers 63 into contact with the corresponding photosensitive drums 61 in a state where all of the photosensitive drums 61 are rotating. When the temporary stop processing is executed in a case where the color printing is performed successively after the color printing is performed, the controller 100 separates all of the developing rollers 63 from the corresponding photosensitive drums 61 and then stops the rotation of all of the photosensitive drums 61, and subsequently restarts the rotation of all of the photosensitive drums 61 and then brings all of the developing rollers 63 into contact with the corresponding photosensitive drums 61.

Next, the following section will describe the operation of the controller 100 in detail. The controller 100 repeatedly executes the processing shown in FIG. 7.

Figure 7:
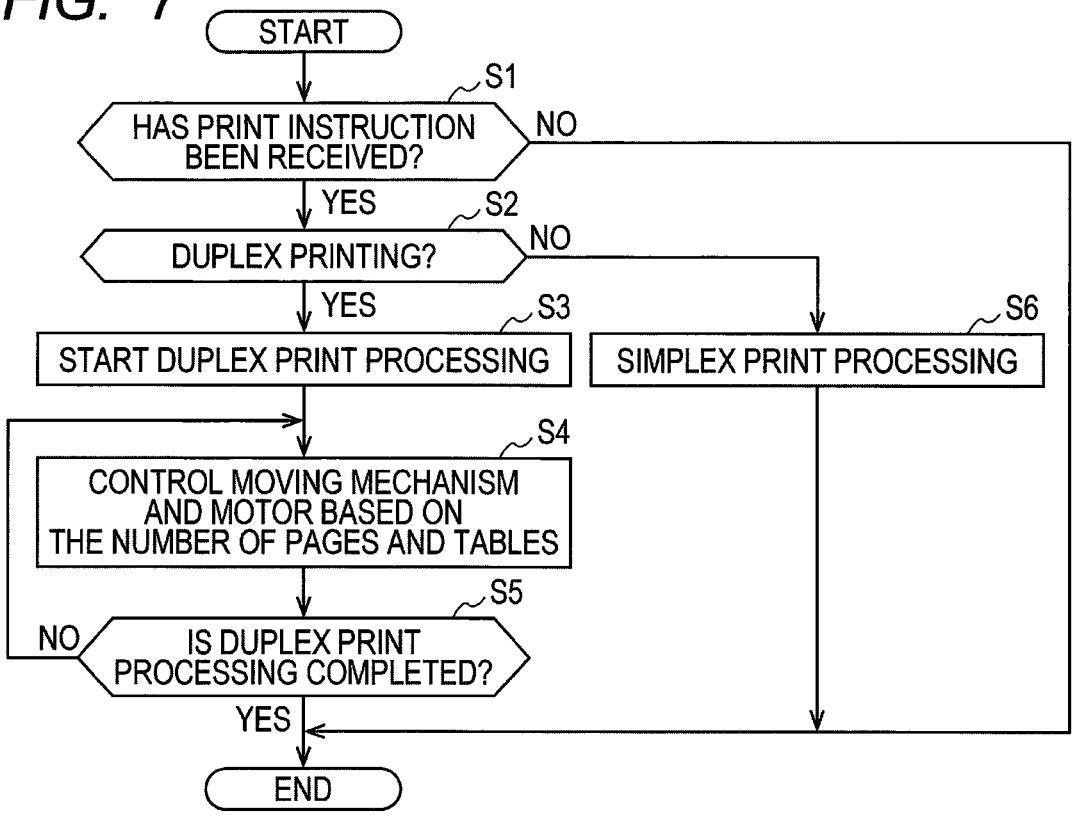
FIG. 7 is a flowchart showing the operation of a controller.

In the processing shown in FIG. 7, the controller 100 firstly determines whether a print instruction has been received (S1). In response to determining in S1 that no print instruction has been received (S1: No), then the controller 100 completes this processing.

In response to determining in S1 that a print instruction has been received (S1: Yes), the controller 100 determines whether duplex printing is to be performed based on the print instruction (S2). In response to determining in S2 that duplex printing is to be performed (S2: Yes), the controller 100 starts the duplex print processing (S3).

After S3, the controller 100 controls the moving mechanism 300 and the motor MT based on the number of pages and the tables of FIGS. 6A to 6C and so on (S4). For example, when the printing mode is the first duplex printing mode and the sheet S has a particular length, the controller 100 selects the first table of FIG. 6A. Then, the controller 100 determines which duplex mode is to be used for printing based on the number of pages to be printed. For example, in a case where the number of pages is four pages, the controller 100 selects the 2413DX mode as the duplex mode. In the 2413DX mode, the inter-sheet time TS between each page is longer than the first time T1 and is shorter than or equal to the second time T2. Thus, the controller 100 performs the temporary separation processing which is set to each page interval in the 2413DX mode, as shown in the tables of FIGS. 6A and 6C.

Returning to FIG. 7, after S4, the controller 100 determines whether the duplex print processing is completed for all pages (S5). In response to determining in S5 that the duplex print processing is not yet completed (S5: No), the controller 100 returns to the processing of S4.

In response to determining in S5 that the duplex print processing is completed (S5: Yes), the controller 100 ends this processing. In response to determining in S2 that the duplex print processing is not to be performed (S2: No), the controller 100 performs simplex (single-sided) print processing of printing only one surface of the sheet S (S6) and ends this processing.

Figure 8:
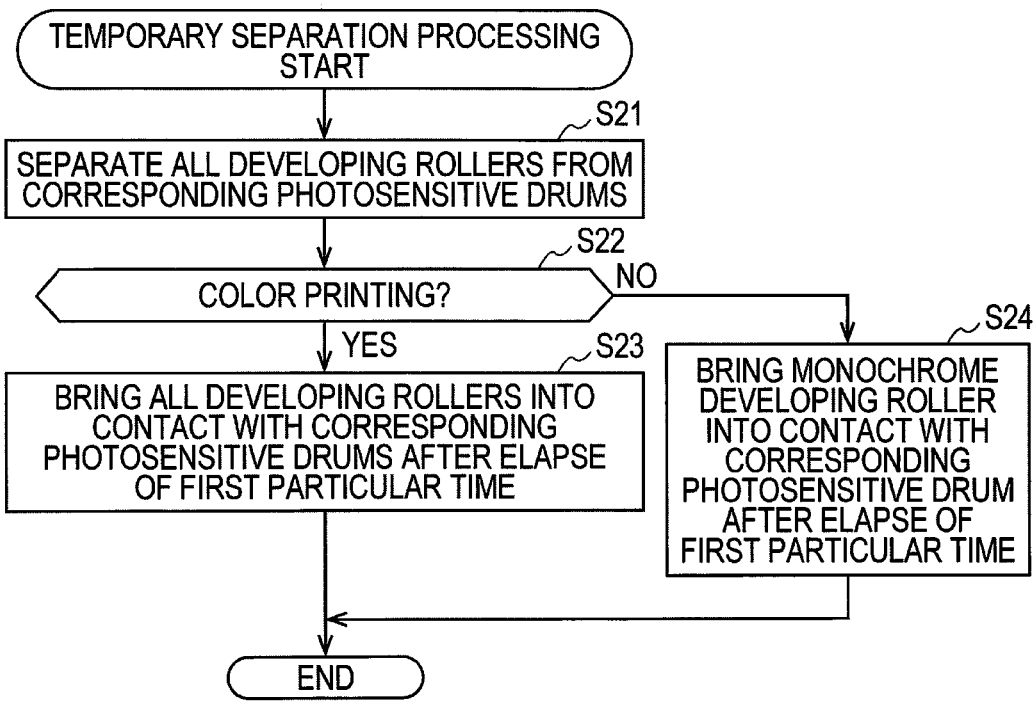
FIG. 8 is a flowchart showing temporary separation processing.

As shown in FIG. 8, in the temporary separation processing, the controller 100 firstly controls the moving mechanism 300 to separate all of the developing rollers 63 from the corresponding photosensitive drums 61 (S21). Specifically, when the previous printing mode is monochrome printing, in S21 the controller 100 separates the monochrome developing roller 63K from the photosensitive drum 61K so that all of the developing rollers 63 are located at the separation position. When the previous printing mode is color printing, in S21 the controller 100 separates all of the developing rollers 63 from the corresponding photosensitive drums 61.

After S21, the controller 100 determines whether the current printing mode is color printing (S22). In response to determining in S22 that the current printing mode is color printing (S22: Yes), the controller 100 controls the moving mechanism 300 to bring all of the developing rollers 63 into contact with the corresponding photosensitive drums 61 after the elapse of a first particular time (S23) and ends this processing. The first particular time is a time having a certain length in order to suppress the deterioration of the developing roller 63 and is set through experiments, simulations, and so on.

In response to determining in S22 that the current printing mode is not color printing (that is, that the current printing mode is monochrome printing) (S22: No), the controller 100 controls the moving mechanism 300 to bring only the monochrome developing roller 63K into contact with the photosensitive drum 61K after the elapse of the first particular time (S24) and ends this processing.

Figure 9:
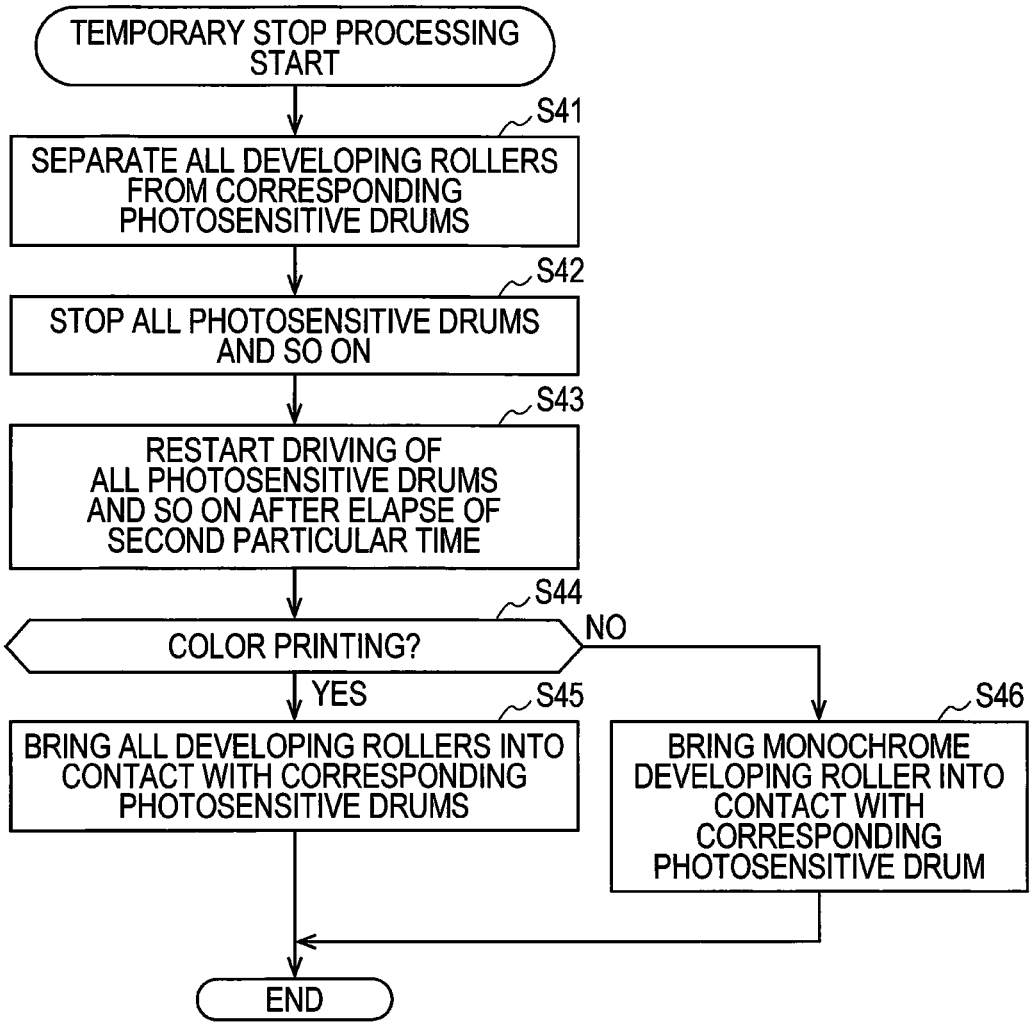
FIG. 9 is a flowchart showing temporary stop processing.

As shown in FIG. 9, in the temporary stop processing, the controller 100 firstly controls the moving mechanism 300 to separate all of the developing rollers 63 from the corresponding photosensitive drums 61 (S41). Specifically, when the previous printing mode is monochrome printing, in S41 the controller 100 separates the monochrome developing roller 63K from the photosensitive drum 61K such that all of the developing rollers 63 are located at the separation position. When the previous printing mode is color printing, in S41 the controller 100 separates all of the developing rollers 63 from the corresponding photosensitive drums 61.

After S41, the controller 100 stops all of the photosensitive drums 61, the drum cleaner 64, and so on (S42). After S42, the controller 100 restarts the driving of all of the photosensitive drums 61, the drum cleaner 64, and so on, after the elapse of a second particular time since the photosensitive drum 61 and so on are stopped (S43). The second particular time is the time having a certain length in order to suppress the deterioration of the developing roller 63 and the photosensitive drum 61 and is set through experiments, simulations, and so on.

After S43, the controller 100 determines whether the current printing mode is the color printing (S44). In response to determining in S44 that the current printing mode is the color printing (S44: Yes), the controller 100 controls all of the developing rollers 63 to contact the corresponding photosensitive drums 61 (S45) and ends this processing.

In response to determining in S44 that the current printing mode is not the color printing (that is, that the current printing mode is the monochrome printing) (S44: No), the controller 100 controls only the monochrome developing roller 63K to contact the photosensitive drum 61K (S46) and ends this processing.

The following effects can be obtained in the embodiment.

In a case where the inter-sheet time TS is longer than the first time T1, by executing the temporary separation processing or the temporary stop processing, the developing roller 63 is temporarily separated from the photosensitive drum 61 and the photosensitive drum 61 is temporarily stopped. Thus, deterioration of the developing roller 63 and the photosensitive drum 61 can be suppressed.

Further, in the embodiment, the temporary separation processing or the temporary stop processing is executed depending on the number of sheets retained in the apparatus in duplex printing, so that the developing roller 63 is temporarily separated from the photosensitive drum 61 and the photosensitive drum 61 is temporarily stopped. Thus, deterioration of the developing roller 63 and the photosensitive drum 61 can be suppressed.

While the disclosure has been described in detail with reference to the above aspects thereof, it would be apparent to those skilled in the art that various changes and modifications may be made therein without departing from the scope of the claims.

In the moving mechanism of the above-described embodiment, the rotary motion of the motor is converted into a reciprocating motion by using a cam and cam follower mechanism, and the developing roller is reciprocated between the contact position and the separation position. The mechanism that converts the rotary motion of the motor into the reciprocating motion is not limited to the cam and cam follower mechanism. Other mechanisms that convert a rotary motion into a reciprocating motion, such as a crank-link mechanism, may be used.

In the above-described embodiment, the motor MT is exemplified as the drive mechanism, but the present disclosure is not limited to this. The drive mechanism may include, for example, a motor and a clutch for switching transmission of a driving force from the motor to the photosensitive drum. In this case, by switching the connection state of the clutch, the rotation and stop of the photosensitive drum may be switched.

In the above-described embodiment, this disclosure is applied to the color printer 1. However, this disclosure is not limited to this, and may be applied to another image forming apparatus, such as a monochrome printer, a copier, and a multifunction peripheral.

In the above-described embodiment, the transfer unit 7 including the conveyance belt 73 has been exemplified as the transfer member, but the present disclosure is not limited to this. The transfer member may be, for example, a transfer roller that contacts the photosensitive drum.

The elements described in the above-described embodiments and modifications may be combined as appropriate.

What is claimed is:

1. An image forming apparatus comprising:

a photosensitive drum;

a developing roller configured to move between a contact position at which the developing roller contacts the photosensitive drum and a separation position at which the developing roller is separated from the photosensitive drum;

a transfer member configured to form a transfer nip with the photosensitive drum;

a moving mechanism configured to move the developing roller between the contact position and the separation position;

a drive mechanism configured to drive the photosensitive drum; and a controller configured to:

in a case where an inter-sheet time is shorter than or equal to a first time, maintain the developing roller in contact with the photosensitive drum during the inter-sheet time, the inter-sheet time being a time after a trailing end of a sheet corresponding to a particular page reaches the transfer nip and before a leading end of a sheet corresponding to a next page reaches the transfer nip in a case where a plurality of pages is printed successively;

in a case where the inter-sheet time is longer than the first time and shorter than or equal to a second time longer than the first time, perform at least part of temporary separation processing during the inter-sheet time, the temporary separation processing being processing of controlling, in a state where the photosensitive drum is rotating, the moving mechanism and the drive mechanism to separate the developing roller from the photosensitive drum and subsequently bring the developing roller into contact with the photosensitive drum;

in a case where the inter-sheet time is longer than the second time, perform at least part of temporary stop processing during the inter-sheet time, the temporary stop processing being processing of controlling the moving mechanism and the drive mechanism to separate the developing roller from the photosensitive drum and then stop rotation of the photosensitive drum, and subsequently restart rotation of the photosensitive drum and then bring the developing roller into contact with the photosensitive drum; and perform duplex print processing of performing printing on both sides of a sheet, wherein the inter-sheet time is set depending on a page interval in the duplex print processing; and wherein the controller is configured to:

when performing the duplex print processing on only one sheet, perform the temporary stop processing during the inter-sheet time between each page;

when performing the duplex print processing on two sheets, perform the temporary separation processing during the inter-sheet time between each page; and when performing the duplex print processing on three or more sheets, perform the temporary separation processing or maintain the developing roller in contact with the photosensitive drum during the inter-sheet time between each page.

2. The image forming apparatus according to claim 1, wherein the controller is configured to perform the temporary stop processing when performing the duplex print processing on only one sheet.

3. The image forming apparatus according to claim 1, wherein the photosensitive drum comprises:

a first photosensitive drum used for both monochrome printing and color printing; and a second photosensitive drum used only for color printing;

wherein the developing roller comprises:

a first developing roller used for both monochrome printing and color printing; and a second developing roller used only for color printing; and wherein the controller is configured to:

when performing the temporary separation processing in a case where monochrome printing is performed successively after color printing is performed, separate the first developing roller and the second developing roller from the first photosensitive drum and the second photosensitive drum, respectively, and then bring only the first developing roller into contact with the first photosensitive drum in a state where the first photosensitive drum and the second photosensitive drum are rotating.

4. The image forming apparatus according to claim 1, wherein the photosensitive drum comprises:

a first photosensitive drum used for both monochrome printing and color printing; and a second photosensitive drum used only for color printing;

wherein the developing roller comprises:

a first developing roller used for both monochrome printing and color printing; and a second developing roller used only for color printing; and wherein the controller is configured to:

when performing the temporary stop processing in a case where monochrome printing is performed successively after color printing is performed, separate the first developing roller and the second developing roller from the first photosensitive drum and the second photosensitive drum, respectively, and then stop rotation of the first photosensitive drum and the second photosensitive drum, and subsequently restart rotation of the first photosensitive drum and the second photosensitive drum and then bring only the first developing roller into contact with the first photosensitive drum.

5. The image forming apparatus according to claim 1, wherein the photosensitive drum comprises:

a first photosensitive drum used for both monochrome printing and color printing; and a second photosensitive drum used only for color printing;

wherein the developing roller comprises:

a first developing roller used for both monochrome printing and color printing; and a second developing roller used only for color printing; and wherein the controller is configured to:

when performing the temporary separation processing in a case where color printing is performed successively after monochrome printing is performed, separate the first developing roller from the first photosensitive drum and then bring the first developing roller and the second developing roller into contact with the first photosensitive drum and the second photosensitive drum, respectively, in a state where the first photosensitive drum and the second photosensitive drum are rotating.

6. The image forming apparatus according to claim 1, wherein the photosensitive drum comprises:

a first photosensitive drum used for both monochrome printing and color printing; and a second photosensitive drum used only for color printing;

wherein the developing roller comprises:

a first developing roller used for both monochrome printing and color printing; and a second developing roller used only for color printing; and wherein the controller is configured to:

when performing the temporary stop processing in a case where color printing is performed successively after monochrome printing is performed, separate the first developing roller from the first photosensitive drum and then stop rotation of the first photosensitive drum and the second photosensitive drum, and subsequently restart rotation of the first photosensitive drum and the second photosensitive drum and then bring the first developing roller and the second developing roller into contact with the first photosensitive drum and the second photosensitive drum, respectively.

7. An image forming apparatus comprising:

a photosensitive drum;

a developing roller configured to move between a contact position at which the developing roller contacts the photosensitive drum and a separation position at which the developing roller is separated from the photosensitive drum;

a transfer member configured to form a transfer nip with the photosensitive drum;

a moving mechanism configured to move the developing roller between the contact position and the separation position;

a drive mechanism configured to drive the photosensitive drum; and a controller configured to:

when performing duplex printing such that only one sheet formed with a toner image on at least one surface thereof is retained within the image forming apparatus, perform at least part of temporary stop processing during a time after a trailing end of a sheet corresponding to a particular page reaches the transfer nip and before a leading end of a sheet corresponding to a next page reaches the transfer nip, the temporary stop processing being processing of controlling the moving mechanism and the drive mechanism to separate the developing roller from the photosensitive drum and then stop rotation of the photosensitive drum and subsequently restart rotation of the photosensitive drum and then bring the developing roller into contact with the photosensitive drum; and when performing duplex printing such that two or more sheets formed with a toner image on at least one surface thereof are retained within the image forming apparatus, maintain the developing roller in contact with the photosensitive drum or perform at least part of temporary separation processing during a time after a trailing end of a sheet corresponding to a particular page reaches the transfer nip and before a leading end of a sheet corresponding to a next page reaches the transfer nip, the temporary separation processing being processing of controlling, in a state where the photosensitive drum is rotating, the moving mechanism and the drive mechanism to separate the developing roller from the photosensitive drum and subsequently bring the developing roller into contact with the photosensitive drum.

* * * * *